United States Patent [19]

Stenz et al.

[11] Patent Number: 4,529,261

[45] Date of Patent: Jul. 16, 1985

[54] CLAMPING CONNECTOR FOR ELECTRICAL CONDUCTORS

[75] Inventors: Paul Stenz; Günter Rubröder; Rainer Schulze; Bernd Haller; Horst Conrad; Heinrich Franke; Manfred Wilmes, all of Detmold, Fed. Rep. of Germany

[73] Assignee: C. A. Weidmüller GmbH & Co., Detmold, Fed. Rep. of Germany

[21] Appl. No.: 448,613

[22] Filed: Dec. 10, 1982

[30] Foreign Application Priority Data

Dec. 17, 1981 [DE] Fed. Rep. of Germany ..... 3149948

[51] Int. Cl.[3] ..... H01R 4/36

[52] U.S. Cl. ..... 339/272 R

[58] Field of Search ..... 339/272, 263

[56] References Cited

U.S. PATENT DOCUMENTS

| | | | |
|---|---|---|---|
| 2,943,294 | 6/1960 | Norden | 339/272 VC |
| 2,976,515 | 3/1961 | Charbonneau et al. | 339/272 VC |

FOREIGN PATENT DOCUMENTS

| | | | |
|---|---|---|---|
| 1091168 | 10/1960 | Fed. Rep. of Germany | 339/272 VC |
| 1229919 | 3/1960 | France | 339/272 VC |
| 1359290 | 3/1964 | France | 339/272 VC |
| 7604642 | 9/1977 | France | 339/272 VC |
| 2459560 | 2/1981 | France | 339/272 R |
| 564261 | 7/1975 | Switzerland | 339/272 VC |

*Primary Examiner*—Eugene F. Desmond
*Assistant Examiner*—David L. Pirlot
*Attorney, Agent, or Firm*—Peter K. Kontler

[57] ABSTRACT

A connector for clamping one or more electrical conductors has a shackle which cooperates with a screw serving to urge one end portion of a rail toward a bottom wall of the shackle. The bottom wall has a central portion flanked by two convergent lateral portions which guide one or more conductors against the internal surface of the central portion when the screw causes the end portion of the rail to approach the bottom wall. The underside of the end portion of the rail has a centrally located platform whose underside urges the conductor or conductors against the central portion of the bottom wall and which is assisted by two ridges disposed between pairs of recesses in the end portion of the rail. The lateral portions of the bottom wall have notches which receive portions of the platform, and the recesses receive portions of the corresponding lateral wall portions. The undersides of the ridges can constitute concave surfaces to further enhance the gathering, centering and clamping effect of the end portion of the rail when the screw is rotated in a direction to advance the end portion toward the inner side of the bottom wall.

15 Claims, 6 Drawing Figures

CLAMPING CONNECTOR FOR ELECTRICAL CONDUCTORS

BACKGROUND OF THE INVENTION

The present invention relates to connectors for electrical conductors in general, and more particularly to improvements in connectors of the type wherein one or more wire-like or analogous electrical conductors can be clamped between a biasing device and the internal surface of a wall forming part of a shackle. More particularly, the invention relates to improvements in connectors of the type wherein the wall of the shackle defines an internal socket which centers the inserted conductor or conductors and wherein the biasing device has a section which is generally complementary to the wall of the shackle and is receivable in the shackle and adapted to be moved toward the wall so that the conductor or conductors are clamped between the biasing device and the internal surface of the wall.

It is already known to employ a shackle and a biasing device in order to clamp one or more wire-like conductors to the surface surrounding the socket in the wall of the shackle. As a rule, the means for urging the biasing device toward the internal surface of the aforementioned wall comprises a screw which meshes with the shackle and whose tip can urge the biasing device toward the internal surface of the wall. Reference may be had to German Pat. No. 923 562 which discloses a series of clamps each of which can be said to constitute a connector. The patented connector is designed to reliably clamp individual wire-like conductors whose diameter can vary within a certain range. However, such connector is incapable of ensuring adequate clamping of a multiple-wire conductor, of several discrete wire-like conductors (especially if the diameters of the conductors are different) and/or of conductors having small or extremely small diameters. This is due to the fact that, if the patented connector receives several wire-like conductors, the distribution of such conductors along the internal surface of the centering wall is unpredictable with the result that the clamping action varies from wire to wire and that certain wires are likely to remain out of contact with the shackle and/or with the biasing device. The situation is analogous in the connector which is disclosed in German Utility Model No. 16 01 608. The connector of the Utility Model is particularly unreliable if the wire-like conductors are thin or very thin because the biasing device is likely to engage and bear against the centering wall of the shackle prior to clamping of such thin conductors.

German Pat. No. 11 16 294 discloses a connector which is designed to clamp discrete (single-wire) conductors, conductors which consist of several components, or several discrete conductors. To this end, the central portion of the shackle comprises inclined internally disposed beads which can extend into complementary sockets or recesses provided therefor in the biasing device. It has been found that even such connectors are insufficiently reliable if the nominal diameters of the conductors are outside of a relatively narrow range. If the diameter of a conductor is rather pronounced, the clamping action is furnished only by the ridges of the beads, i.e., the area of clamping engagement with the conductors is relatively small and the wires are subjected to the action of very pronounced buckling and shearing forces. In order to avoid such drawbacks, at least when the nonimal diameters of the conductors are within the prescribed range, the beaded portion of the shackle must be configurated in such a way that the neighboring beads are separated from one another by portions having flat surfaces. This, in turn, greatly reduces the reliability of the clamping action if the diameters of the conductors are small or very small because the clamping action of the patented connector upon thin wires is not superior to that of a connector wherein the wire is simply held between two flat surfaces. In other words, the centering action upon one or more thin conductor wires is practically nil and, therefore, such wires are likely to become separated from the connector during laying when the wires must be subjected to repeated and often quite pronounced tensional and like stresses. The exertion of a pull upon the inserted wire or wires is likely to result in removal of shavings of copper or whatever material the conductor is made of, and the unavoidable result is a loosening of connection between the wire or wires and the connector. The connector of German Pat. No. 11 16 294 is highly unreliable when the patented device is to receive and clamp several conductors having different diameters.

OBJECTS AND SUMMARY OF THE INVENTION

An object of the invention is to provide a connector which is more versatile than heretofore known connectors.

Another object of the invention is to provide a connector which can reliably engage and hold individual wire-like or analogous conductors, groups of small-diameter or larger-diameter conductors, as well as groups of conductors having widely different diameters.

A further object of the invention is to provide a connector which can be used as a superior substitute for heretofore known connectors and which treats the conductors gently while holding them firmly between the shackle and the biasing device.

An additional object of the invention is to provide a connector which can be furnished in any one of a wide variety of sizes and shapes, wherein a single biasing device can cooperate with several shackles, and which can be manipulated by resort to simple and readily available tools.

Another object of the invention is to provide a novel and improved method of clamping discrete wire-like or analogous conductors, or groups of conductors, between a pair of complementary components of a connector.

A further object of the invention is to provide a novel and improved shackle for use in a connector of the above outlined character.

An additional object of the invention is to provide a novel and improved biasing device for use in the above outlined connector.

The invention is embodied in a connector for one or more electrical conductors which comprises a hollow shackle including a wall which defines a centering socket for reception of at least one electrical conductor and which includes a central portion with a substantially flat internal surface and internally notched lateral portions flanking the central portion, and a biasing device including a section which extends into the shackle and is arranged to maintain a conductor which is inserted into the socket in contact with the shackle. Such section of the biasing device comprises a platform, at least one pair of recesses adjacent to the platform and serving to receive the lateral portions of the wall, and a ridge disposed between the recesses and having a conductor-contacting surface disposed opposite the internal surface of the central wall portion. Portions of the platform extend into the notches of the lateral portions of the wall, and the connector further comprises a screw, bolt or other suitable means for releasably urging the section of the biasing device toward the wall of the shackle to thereby clamp one or more conductors between the section and the wall. The contacting surface of the ridge can be at least substantially coplanar with the internal surface of the central wall portion in the absence of one or more conductors between the section and the wall.

The biasing device can comprise an elongated rail, and the aforementioned section can constitute one end portion of the rail. The other end portion of the rail can constitute a second biasing section which is insertable into a second shackle.

The section can include a portion of maximum cross-sectional area which includes the platform and at least one portion of reduced cross-sectional area which includes the recesses and the ridge. Still further, the section can comprise a second portion of maximum cross-sectional area which is spaced apart from the first mentioned portion of maximum cross-sectional area and is located outside of the shackle; the portion of reduced cross-sectional area is then located between the two portions of maximum cross-sectional area.

The section of the biasing device can have two pairs of recesses and a ridge between each pair of recesses; the platform is then disposed between the two pairs of recesses and its exposed surface is preferably flush with the contacting surfaces of the two ridges.

The platform can have a roughened surface which is adjacent to the wall of the shackle. Alternatively, or in addition to such configuration of the platform, the contacting surface of the ridge can be roughened to enhance the establishment of adequate contact between one or more conductors and the shackle and/or biasing device. Still further, the internal surface of the central portion of the wall can be roughened and/or the lateral portions of such wall can be formed with roughened internal surfaces.

The notches in the lateral portions of the wall can be defined by outwardly stamped regions of such lateral portions; alternatively, the notches can constitute holes which are provided in the lateral portions of the wall.

In accordance with a modification, the internal surface of the central portion of the wall and/or the contacting surface of the ridge can be a concave surface, and the concavity of such surface is preferably selected with a view to provide room for several conductors between the two surfaces. The concave surface preferably extends across the entire wall of the shackle.

The novel features which are considered as characteristic of the invention are set forth in particular in the appended claims. The improved connector itself, however, both as to its construction and the mode of assembling the same, together with additional features and advantages thereof, will be best understood upon perusal of the following detailed description of certain specific embodiments with reference to the accompanying drawing.

DESCRIPTION OF THE PREFERRED EMBODIMENTS

Figure 5:
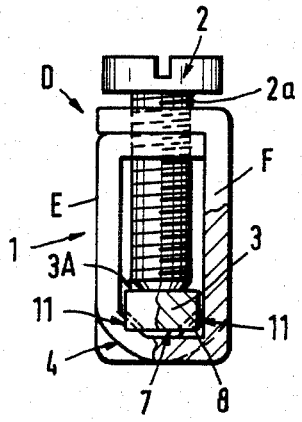
FIG. 5 is an enlarged partly end elevational and partly sectional view of a fully assembled connector with one section of the biasing device extending into the interior of the shackle and being urged against the bottom wall of the shackle by a screw which meshes with the top wall of the shackle.

The clamping connector which embodies the present invention is normally installed in an insulating housing or enclosure (not specifically shown) and comprises a biasing device 3 (here shown as an elongated rail) and two hollow shackles 1. In addition, the connector comprises two screws, bolts or analogous means 2 for urging the biasing device 3 into adequate engagement with the two shackles. The biasing device 3 establishes an electrical connection between the two shackles and hence between one or more wire-like or otherwise configurated electrical conductors which are clamped between one of the shackles and the respective end portion (3A) of the device 3 and one or more wire-like or otherwise configurated conductors which are clamped between the other shackle and the other end portion (3A) of the device 3. With reference to FIG. 5, the conductor or conductors are inserted between the illustrated end portion or section 3A of the biasing device 3 and the bottom wall B of the illustrated shackle 1, and the screw 2 is thereupon tightened to urge the section 3A toward the inner side of the wall B. The shank 2*a* of the screw 2 meshes with the composite top wall D of the shackle 1. FIG. 5 shows the illustrated section 3A of the biasing device 3 in its lower end position because no conductors are placed between the wall B and the section 3A. The space between the section 3A and the wall B can accommodate a single wire-like conductor, a composite conductor consisting of two or more wires, or a set of several conductors whose diameters may but need not be identical.

Figure 3:
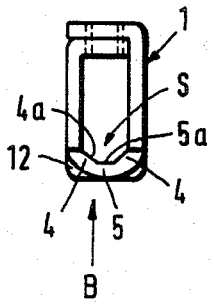
FIG. 3 is an end elevational view of a shackle which can be used with the biasing device of FIGS. 1 and 2.
Figure 4:
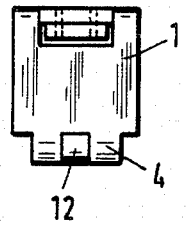
FIG. 4 is a side elevational view of the shackle which is shown in FIG. 3.

The bottom wall B of the shackle 1 which is shown in FIGS. 3 to 5 defines a centering socket S for reception of one or more conductors. This socket is bounded by the internal surface 5*a* of a central portion 5 and by the internal surfaces 4*a* of two lateral portions 4 of the bottom wall B. The portion 5 is located substantially midway between the sidewalls E and F of the shackle 1. One or more conductors which are inserted into the interior of the shackle 1 are caused to advance toward the bottom wall B and to slide along the internal surface or surfaces 4*a* toward and onto the bottom surface 5*a* so that the conductor or conductors are centered in the shackle before the screw 2 is tightened to ensure the establishment of a reliable electrical connection between such conductor or conductors on the one hand and the parts 1, 3 on the other hand. The central portion 5 is preferably rounded and its internal bottom surface 5*a* or may be at least substantially flat. The lateral portions 4 of the bottom wall B can be said to constitute a means for automatically centering one or more conductors in the socket S of the shackle 1 when the corresponding section 3A of the biasing device 3 is caused to move toward the inner side of the bottom wall.

Figure 1:
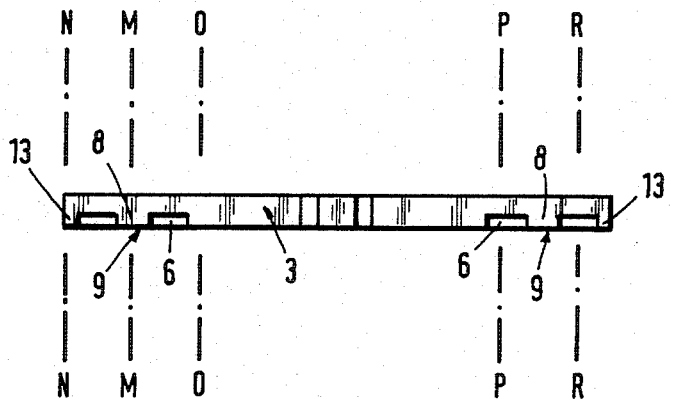
FIG. 1 is a schematic elevational view of a biasing device comprising two sections which are configurated in accordance with one embodiment of the present invention.

The two end portions or sections 3A of the biasing device 3 are mirror symmetrical to each other with reference to a plane which is normal to the plane of the drawing and halves the biasing device. Each of the two sections 3A has two pairs of recesses 6 which are disposed at the opposite sides of a platform 8, and the recesses 6 of each pair flank a ridge 7 which extends lengthwise of the biasing device 3 and has an exposed conductor-contacting surface 7*a* which is coplanar with the exposed surface 9 of the respective platform 8. A comparison of FIGS. 1 and 2 will reveal that each of the two sections 3A comprises a first portion of maximum cross-sectional area (in the plane M—M) which includes the respective platform 8, a second portion of maximum cross-sectional area (in the plane N—N) which includes a first auxiliary or additional platform 13 (at the very tip of the respective section), a third portion of maximum cross-sectional sectional area (in the plane O—O) which includes a second auxiliary or additional platform 13*a*, and two portions of reduced cross-sectional area (in the planes P—P and R—R) each of which includes a pair of recesses 6 and the ridge 7 therebetween. The portions of reduced cross-sectional area alternate with the portions of maximum cross-sectional area. The recesses 6 can be formed by removing some material from the biasing device 3 so that the bottom surfaces in the recesses make acute angles with the respective edge faces of the biasing device. Each of the ridges 7 in the biasing device 3 of FIGS. 1, 2 and 5 can be said to resemble a tooth having a top land (conductor-contacting surface 7*a*) and two mirror symmetrical flanks constituted by the surfaces in the respective recesses 6. The dimensions of each of the two sections 3A are selected in such a way that either thereof can come into practically full surface-to-surface contact with the internal surface of the bottom wall B if no conductor means are inserted between the wall B and the respective section 3A. In other words, the surface 9 of a platform 8 can come in direct contact with the bottom surface 5*a* of the central bottom wall portion 5 in the absence of one or more conductors between such surfaces. The recesses 6 of each section 3A can be fully confined in the respective shackle 1 when the section 3A is properly inserted into the interior of the shackle.

As mentioned above, the exposed surface 9 of each platform 8 is at least substantially coplanar with the exposed conductor-contacting surfaces 7*a* of the adjoining ridges 7. In other words, the removal of material to form the recesses 6 is carried out in such a way that the thickness of the respective section 3A in the region of each of the ridges 7 is the same as the thickness of the associated platform 8.

The lateral portions 4 of the bottom wall B of the shackle 1 are formed with internal notches 11 which can receive portions of the respective platform 8 when the corresponding section 3A is moved close to or into actual contact with the inner side of the bottom wall B. In other words, the notches 11 are dimensioned in such a way that the entire platform 8 of the respective section 3A can move into contact with the bottom wall B when the screw 2 is tightened and the operator does not insert one or more wires into the socket S. In the embodiment of the shackle 1 which is shown in FIGS. 3, 4 and 5, the notches 11 are obtained by stamping (at 12) the corresponding regions of the lateral wall portions 4. Alternatively, it is also possible to form the notches 11 by making holes in the corresponding regions of the lateral wall portions 4 or by simply removing from the internal surfaces of the portions 4 sufficient quantities of material to allow the entire platform 8 of the respective section 3A to move into contact with the bottom wall B.

Figure 2:
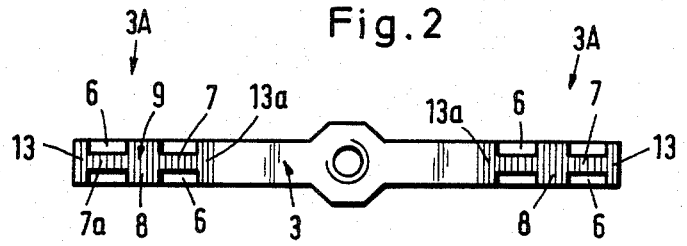
FIG. 2 is a bottom plan view of the biasing device which is shown in FIG. 1.

The surfaces 7*a* of the ridges 7, the exposed surfaces 9 of the platforms 8 and/or the exposed surfaces of the platforms 13 and/or 13*a* can be grooved and/or otherwise roughened to ensure more reliable contact with the conductors. This is indicated by vertical lines which are shown in FIG. 2. Analogously, or in lieu of such roughening of the ridges 7 and platforms 8, 13 and/or 13*a*, it is equally possible and often desirable to roughen the bottom surface 5*a* of the central wall portion 5 and/or the surfaces 4*a* of the lateral wall portions 4. This also contributes to establishment of more reliable electrical connections between the conductors on the one hand and the parts 1, 3 on the other hand.

It has been found that the mutually inclined lateral portions 4 of the bottom wall B reliably guide individual conductors or groups of two or more conductors toward and onto the internal surface 5*a* of the central wall portion 5 when the respective section 3A of the biasing device 3 is caused to descend toward the socket S. It was also ascertained that such design of the sections of the biasing device 3 and of the wall B of the shackle 1 invariably ensures predictable and reproducible optimum centering of conductors having small, very small, medium, large or very large diameters, irrespective of whether the space between the section 3A and the wall B accommodates one or more conductors. The properly engaged conductor or conductors are clamped with requisite force to prevent them from swaying back and forth in response to necessary manipulations of the connector, and the connection is not likely to become loose, e.g., as a result of removal of some copper from the conductor or conductors. Moreover, and since each section 3A can be moved practically into full surface-to-surface contact with the bottom wall B, the improved connector can adequately engage wire-like or analogous conductors whose diameters are extremely small so that they are unlikely to be adequately held in heretofore known connectors. The area of contact between the clamped wire or wires and the bottom wall is large which is always desirable in connectors of such character.

The improved connector can properly center and clamp multiple-wire conductors, conductors which consist of extremely thin wire as well as several conductors each of which has a different diameter and each of which may consist of two or more wires. When a section 3A is urged toward the corresponding bottom wall B, the ridges 8 extend in part outwardly beyond the respective lateral wall portions 4 and ensure that, during clamping, the distribution of several wires of a single conductor or several discrete conductors is predictable and optimal insofar as the establishment of an electrical connection is concerned. Such wires or conductors are caused to slide along the internal surfaces 4*a* and toward and onto the bottom surface 5*a* of the central wall portion 5, i.e., the wall portions 4 ensure that the wires or conductors gather in the deepmost central portion of the socket S, namely, in or close to the central vertical symmetry plane of the shackle 1, as viewed in FIG. 3 or 5. When the screw 2 is applied with requisite force, the wires or conductors in the deepmost central portion of the socket S are urged against each other, against the surface 5*a* and against the adjacent portion of the corresponding section 3A. Such centering and gathering of wires or conductors ensures highly reliable establishment of electrical connections, even if the diameters of the wires forming part of a single conductor or constituting two or more discrete conductors vary within a wide range.

The additional platform 13 of each section 3A is first to be inserted into the shackle 1 when the improved connector is in the process of being assembled. The underside of such platform 13 (whose cross-sectional area preferably equals or at least approximates that of the respective platform 8) assists the associated platform 8 in gathering and centering the wire or wires in the socket S. This also applies for the undersides of the additional platforms 13*a* which are inwardly adjacent to the inner pair of recesses 6 in the respective sections of the biasing device 3.

Figure 6:
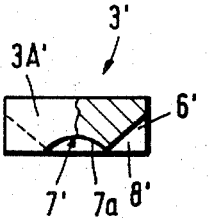
FIG. 6 is an end elevational view of a modified biasing device, with a portion of one of its sections broken away.

FIG. 6 shows the section 3A′ of a modified biasing device 3′ wherein the conductor-contacting surface 7*a* of each ridge 7′ between a pair of recesses 6′ is a concave surface. Such configuration of the surface 7*a* enables the improved connector to even more reliably gather the conductor or conductors in the region between the section 3A′ and the central portion 5 of the bottom wall B of the shackle 1 (not shown in FIG. 6). The gathering and centering action of the connector which embodies a biasing device with a section corresponding to that shown at 3A′ is highly satisfactory irrespective of the number and diameters of the wires which constitute or form part of the conductors. It has been found that the concave surface 7*a* of the ridge 7′ shown in FIG. 6 performs a highly desirable centering, gathering and compacting action.

The connector which employs the section 3A′ of FIG. 6 is especially suited for the clamping of large-diameter conductors, irrespective of whether the conductors consist of several wires or a single wire. The underside of the platform 8′ can be configurated so as to constitute an extension of the concave surfaces 7*a*, i.e., a concave surface of the section 3A′ can extend across the entire bottom wall of the shackle.

The improved connector is susceptible of many additional modifications without departing from the spirit of the invention. For example, each of the sections 3A or 3A′ can constitute a discrete biasing device and the connection between the two shackles of a connector can be established by providing an electrical connection between the screws 2 of the two shackles. Furthermore, the configuration of the shackles can depart from that which is shown in FIG. 3, 4 or 5, as long as the shackles can cooperate with the biasing device in a manner as explained above. Still further, screws or other externally threaded fasteners constitute but one form of the means which can be used to urge a section of a biasing device toward the wall B of the corresponding shackle.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. A connector for electrical conductors, comprising at least one hollow one-piece shackle defining a centering socket for reception of at least one conductor, said shackle comprising two upstanding side walls, a flat internal bottom surface angularly disposed to said side walls, and two lateral portions flanking said bottom surface and forming an obtuse angle thereto, stamped notches in said lateral portions, a biasing device including a section extending into said shackle and arranged to maintain a conductor which is inserted into said socket in contact with said shackle, said section comprising a platform defining a planar surface parallel to said bottom surface, at least one pair of recesses adjacent to said platform and arranged to receive the lateral portions of said shackle, said recesses defining surfaces parallel to said lateral portions, and a ridge disposed between said recesses and having a conductor-containing surface opposite said bottom surface, edge portions of said platform extending fully into the notches of said lateral portions only in the absence of any conductors in said socket between said bottom surface and said ridge whereby, simultaneously, the recessed' angled surfaces are in flush abutting relationship to said lateral portions and the platform planar surface is in flush abutting relationship to said bottom surface in the absence of any conductors in said socket; and means for releasably urging said section toward said bottom surface.

2. The connector of claim 1, wherein said contacting surface is at least substantially coplanar with said bottom surface in the absence of conductors between said shackle and said section.

3. The connector of claim 1, wherein said biasing device comprises an elongated rail and said section constitutes one end portion of said rail, said rail having a second end portion constituting a second section which is insertable into a second shackle.

4. The connector of claim 1, wherein said section comprises a portion of maximum cross-sectional area which includes said platform and at least one portion of reduced cross-sectional area which includes the recesses and the ridge.

5. The connector of claim 1, wherein said section has two pairs of recesses and said platform is disposed between such pairs of recesses.

6. The connector of claim 1, wherein said section comprises a first portion of maximum cross-sectional area which includes said platform, a second portion of maximum cross-sectional area spaced apart from said first portion and located outside of said shackle, and a portion of reduced cross-sectional area disposed between said first and second portions and including said recesses and said ridge.

7. The connector of claim 1, wherein said platform has a roughened surface adjacent to said shackle.

8. The connector of claim 1, wherein the contacting surface of said ridge is roughened.

9. The connector of claim 1, wherein said bottom surface is roughened.

10. The connector of claim 1, wherein said lateral portions of said wall have roughened internal surfaces.

11. The connector of claim 1, wherein the notches of said lateral portions are defined by outwardly stamped regions of such lateral portions.

12. The connector of claim 1, wherein the notches of said lateral portions are holes provided in such lateral portions.

13. The connector of claim 1, wherein one of said conductor-contacting surface and said bottom surface is a concave surface.

14. The connector of claim 13, wherein said one surface is said contacting surface and the concavity of such contacting surface suffices to provide room for several conductors between said conductor contacting surface and said bottom surface.

15. The connector of claim 14, wherein said concave surface extends across the entire wall of said shackle.

* * * * *